United States Patent [19]

Rave

[11] 4,156,628

[45] * May 29, 1979

[54] PREPARATION OF HYDROPHILIC POLYOLEFIN FIBERS FOR USE IN PAPERMAKING

[75] Inventor: Terence W. Rave, Wilmington, Del.

[73] Assignee: Hercules Incorporated, Wilmington, Del.

[ * ] Notice: The portion of the term of this patent subsequent to Jul. 12, 1994, has been disclaimed.

[21] Appl. No.: 818,364

[22] Filed: Jul. 25, 1977

Related U.S. Application Data

[60] Continuation-in-part of Ser. No. 721,133, Sep. 7, 1976, abandoned, which is a continuation-in-part of Ser. No. 653,188, Jan. 28, 1976, Pat. No. 4,035,229, which is a division of Ser. No. 521,002, Nov. 4, 1974, abandoned.

[51] Int. Cl.[2] ..... D21H 5/12

[52] U.S. Cl. ..... 162/157 R; 162/146; 162/164 R; 162/164 EP; 162/168 R; 162/168 N; 162/168 NA; 162/182; 427/221; 427/444

[58] Field of Search ..... 260/29.2 EP, 29.2 N, 260/29.6 H, 29.6 NR; 162/164 R, 164 EP, 146, 157 R, 166, 167, 168 N, 168 NA, 168 R, 182; 427/444, 221; 428/394, 395

[56] References Cited

U.S. PATENT DOCUMENTS

| | | | |
|---|---|---|---|
| 2,595,935 | 5/1952 | Daniel et al. | 161/166 |
| 2,601,597 | 6/1952 | Daniel et al. | 162/166 |
| 2,926,116 | 2/1960 | Keim | 162/164 EP |
| 3,240,664 | 3/1966 | Earle | 162/164 EP |
| 3,556,932 | 1/1971 | Coscia et al. | 162/168 NA |
| 3,677,888 | 7/1972 | Economou | 162/168 NA |
| 3,700,623 | 10/1972 | Keim | 162/168 N |
| 3,743,570 | 7/1973 | Yang et al. | 162/157 R |
| 3,816,556 | 6/1974 | Coscia et al. | 162/168 NA |

FOREIGN PATENT DOCUMENTS 2413922 10/1974 Fed. Rep. of Germany.

*Primary Examiner*—S. Leon Bashore
*Assistant Examiner*—Peter Chin
*Attorney, Agent, or Firm*—John W. Whitson

[57] ABSTRACT

Hydrophilic polyolefin fibers may be prepared, for example, by discharging a heated and pressurized solution of an anionic polyolefin composition containing carboxylic functionality into a zone of reduced temperature and pressure, and then modifying the fibers so produced by treatment with an aqueous admixture of selected cationic and anionic water-soluble, nitrogen-containing polymers. Blends of the hydrophilic fibers with wood pulp provide paper products having improved physical properties.

10 Claims, No Drawings

PREPARATION OF HYDROPHILIC POLYOLEFIN FIBERS FOR USE IN PAPERMAKING

This application is a continuation-in-part of application Ser. No. 721,133, filed Sept. 7, 1976 now abandoned, which in turn is a continuation-in-part of application Ser. No. 653,188, filed Jan. 28, 1976 now U.S. Pat. No. 4,035,229, which in turn is a division of application Ser. No. 521,002, filed Nov. 4, 1974, now abandoned.

This invention relates to a process for the preparation of hydrophilic polyolefin fibers which are readily dispersible in water and which can be blended with wood pulp fibers to provide a pulp which can be made into high quality paper using conventional papermaking techniques. More particularly, the invention relates to the formation of polyolefin-based fibers containing carboxylic functionality and treatment of these fibers with blends of certain water-soluble, nitrogen-containing polymers, one of which is cationic and the other of which is anionic. The invention also relates to specific blends of the cationic and anionic polymers.

In recent years, a considerable amount of effort has been expended in the development of fibrous polyolefin pulps having hydrophilic properties. One procedure developed for the purpose of attaining such hydrophilic properties is that described in U.S. Pat. No. 3,743,570 to Yang et al, assigned to Crown Zellerbach Corporation. According to this patent, polyolefin fibers having a high surface area are treated with a hydrophilic colloidal polymeric additive composed of a cationic polymer such as melamine-formaldehyde and an anionic polymer such as carboxymethyl cellulose. Another procedure developed for the preparation of hydrophilic polyolefin pulps has been one involving the spurting of a mixture of the polyolefin and an additive such as a hydrophilic clay or a hydrophilic polymer, for example, polyvinyl alcohol. The spurting process used in these preparations is one in which the polyolefin and the hydrophilic additive are dispersed in a liquid which is not a solvent for either component at its normal boiling point, heating the resulting dispersion at superatmospheric pressure to dissolve the polymer and any solvent-soluble additive, and then discharging the resulting composition into a zone of reduced temperature and pressure, usually atmospheric, to form the fibrous product.

A significant deficiency of these hydrophilic polyolefin pulps has been that, when they have been blended with wood pulp, the resulting paper products have exhibited considerably less strength than that of a paper prepared from wood pulp alone. However, some improvement in the strength of paper made from blends of polyolefin pulps and wood pulp has been realized by imparting an anionic character to the polyolefin pulp. For example, in their German application No. 413,922, filed Mar. 22, 1974 and published Oct. 17, 1974 as No. 2,413,922, Toray Industries, Inc. have disclosed the preparation of anionic pulps by spurting mixtures of polyolefins and copolymers of olefinic compounds with maleic anhydride or acrylic or methacrylic acids. Blends of these pulps with wood pulp have provided paper with better tensile strength than paper made without the copolymer component.

Now in accordance with this invention, it has been found that paper having further improved strength properties can be prepared by forming a spurted fibrous anionic polyolefin composition containing carboxylic functionality, for example, a spurted fibrous composition comprising a mixture of a polyolefin and a carboxyl-containing anionic polymer, and then modifying this fibrous product by disc refining the fibers in a dilute aqueous solution or dispersion of a blend of a certain type of cationic, water-soluble, nitrogen-containing polymer and a certain type of anionic, water-soluble, nitrogen-containing polymer. The fiber modifying step of the process of this invention results in deposition of the blend of cationic and anionic nitrogen-containing polymers on the spurted fibers, and the originally anionic fibers are converted into modified fibers which are capable of bonding to the cellulosic fibers of wood pulp.

As an example of the process of this invention, polypropylene and an ethylene-acrylic acid copolymer are dispersed in a solvent such as methylene chloride, and the dispersion is heated in a closed system to a temperature of about 190° C. to dissolve the polymer components in the solvent. Under these conditions, the pressure generated by the methylene chloride vapors is of the order of 600 p.s.i. After introducing nitrogen to increase the vapor pressure of the system to a pressure of about 1000 p.s.i., the resulting solution is vented to the atmosphere through an orifice, resulting in evaporation of the methylene chloride solvent and formation of the fiber product. The fiber product then is suspended in an aqueous medium formed by blending a dilute aqueous solution of, for example, epichlorohydrin-modified poly(diethylenetriamine-adipic acid) with a dilute aqueous solution of, for example, glyoxal-modified poly(acrylamide-co-acrylic acid), and the components of the resulting suspension are brought into intimate contact with each other by refining in a disc refiner. The treated fibers may then be isolated and stored in wet cake form, or the suspension containing the fibers may be used directly in a papermaking process.

Having generally outlined the embodiments of this invention, the following examples constitute specific illustrations thereof. All amounts are based on parts by weight.

EXAMPLE A

A cationic, water-soluble, nitrogen-containing polymer was prepared from diethylenetriamine, adipic acid and epichlorohydrin. Diethylenetriamine in the amount of 0.97 mole was added to a reaction vessel equipped with a mechanical stirrer, a thermometer and a reflux condenser. There then was gradually added to the reaction vessel one mole of adipic acid with stirring. After the acid had dissolved in the amine, the reaction mixture was heated to 170°–175° C. and held at that temperature for one and one-half hours, at which time the reaction mixture had become very viscous. The reaction mixture then was cooled to 140° C., and sufficient water was added to provide the resulting polyamide solution with a solids content of about 50%. A sample of the polyamide isolated from this solution was found to have a reduced specific viscosity of 0.155 deciliters per gram when measured at a concentration of two percent in a one molar aqueous solution of ammonium chloride. The polyamide solution was diluted to 13.5% solids and heated to 40° C., and epichlorohydrin was slowly added in an amount corresponding to 1.32 moles per mole of secondary amine in the polyamide. The reaction mixture then was heated at a temperature between 70° and 75° C. until it attained a Gardner viscosity of E-F. Sufficient water next was added to provide a solids content of about 12.5%, and the solution was cooled to 25° C. The pH of the solution then was adjusted to 4.7 with concentrated sulfuric acid. The final product contained 12.5% solids and had a Gardner viscosity of B-C.

EXAMPLE B

Another representative cationic, water-soluble, nitrogen-containing polymer was prepared, this time using epichlorohydrin and a commercially available liquid mixture of polyamines as the reactants. This mixture contained at least 75% of bis(hexamethylene)triamine and higher homologues, the remainder of the mixture consisting of lower molecular weight amines, nitriles and lactams. The reaction was carried out in a kettle fitted with a steam jet vacuum system used to exhaust vapors through a condenser instead of permitting them to escape through an open port in the kettle.

The kettle was charged with 704 parts of water and 476 parts of epichlorohydrin, and then 420 parts of the commercial mixture of polyamines was added to the kettle over a period of 35 minutes, the reaction mixture being cooled to prevent the temperature from exceeding 70° C. After addition of the amine, six parts of aqueous 20% sodium hydroxide was added to accelerate the reaction and, after a total of 160 minutes at about 70° C., the reaction mixture was diluted with 640 parts of water to reduce the viscosity to a Gardner value of about C. A total of 44 parts of aqueous 20% sodium hydroxide then was added over a period of 105 minutes. A Gardner viscosity of S was reached after 215 minutes, at which point the reaction was terminated by the addition of 26 parts of concentrated sulfuric acid dissolved in 1345 parts of water. The resulting solution had a Gardner viscosity of D, and additional sulfuric acid and water were added to adjust the pH to 4 and provide a solids content of 22.5%.

EXAMPLE C

A further cationic, water-soluble, nitrogen-containing polymer was prepared, the basic reactants being methyldiallylamine and epichlorohydrin. To 333 parts of methyldiallylamine was slowly added 290–295 parts of concentrated hydrochloric acid to provide a solution having a pH of 3 to 4. The solution then was sparged with nitrogen for 20 minutes and the temperature was adjusted to 50° to 60° C. An aqueous 10.7% solution of sodium bisulfite and an aqueous 10.1% solution of t-butyl hydroperoxide were simultaneously added to the reaction mixture over a period of four to five hours until the resulting polymer, poly(methyldiallylamine hydrochloride), had a reduced specific viscosity of 0.2 as measured on a one percent solution in aqueous one molar sodium chloride at 25° C. The amount of each of the sodium bisulfite and the t-butyl hydroperoxide used was two mole percent based on the polymer repeat units.

To the above polymer solution there then was added 600 parts of aqueous four percent sodium hydroxide, and the temperature of the resulting solution was adjusted to 35° C. After addition of sufficient water to bring the solids content of the polymer solution to 22%, there was added 416.3 parts of epichlorohydrin. The temperature of the reaction mixture was maintained at about 45° C. while the Gardner viscosity of the mixture increased from less than A to B+. After the addition of about 304 parts of 36% hydrochloric acid, the reaction mixture was heated to 80° C. and maintained at this temperature with continual addition of further amounts of hydrochloric acid until the pH of the reaction mixture had stabilized at 2 for one hour. The reaction mixture then was cooled to 40° C., adjusted to a pH of 3.5–4.0 with aqueous four percent sodium hydroxide and diluted to 20% solids.

The resin product from the above process, prior to use in accordance with this invention, must be base activated. This is accomplished by adding 18 parts of water and 12 parts of one molar sodium hydroxide solution to each 10 parts of the 20% solids solution of the resin. The resulting five percent solids solution, after aging for 15 minutes, should have a pH of 10 or higher. Additional sodium hydroxide should be added, if necessary, to obtain this level of pH.

EXAMPLE D

Another useful cationic, water-soluble, nitrogen-containing polymer was prepared from bis(3-aminopropyl)-methylamine, urea and epichlorohydrin. Two hundred ten parts of the amine and 87 parts of urea were placed in a reaction vessel, heated to 175° C., held at this temperature for one hour and then cooled to 155° C. Water was added to the reaction product in the amount of 375 parts, and the resulting solution was cooled to room temperature.

To 271 parts of the above solution was added 321 parts of water, 29 parts of concentrated hydrochloric acid and 89.6 parts of epichlorohydrin. The temperature of the reaction mixture was maintained in the range of 39° to 42° C. for about 85 minutes while the Gardner viscosity of the mixture increased from A-B to L+. There then was added to the mixture 60 parts of concentrated hydrochloric acid, and the resulting mixture was heated for four hours at a temperature in the range of 60° to 75° C., nine more parts of hydrochloric acid being added after about one and one-half hours to keep the pH below 2. The mixture then was cooled to room temperature. The resulting epichlorohydrin-modified polyaminourylene product contained 27% solids.

The above product, prior to use in accordance with this invention, also must be base activated. Activation is accomplished by adding ten parts of the above product to 10 parts of one molar sodium hydroxide solution, aging the resulting solution for 15 minutes, and then diluting the solution (13.5% solids) to five percent solids or less for use.

EXAMPLE E

An anionic, water-soluble, nitrogen-containing polymer was prepared from acrylamide, acrylic acid and glyoxal. To a reaction vessel equipped with a mechanical stirrer, a thermometer, a reflux condenser and a nitrogen adapter was added 890 parts of water. There then was dissolved in the water 98 parts of acrylamide, two parts of acrylic acid and one and one-half parts of aqueous 10% cupric sulfate. The resulting solution was sparged with nitrogen and heated to 76° C., at which point two parts of ammonium persulfate dissolved in six and one-half parts of water was added. The temperature of the reaction mixture increased 21.5° C. over a period of three minutes following addition of the persulfate. When the temperature returned to 76° C., it was maintained there for two hours, after which the reaction mixture was cooled to room temperature. The resulting solution had a Brookfield viscosity of 54 centipoises at 21° C. and contained less than 0.2% acrylamide based on the polymer content.

To 766.9 parts of the above solution (76.7 parts of polymer containing 75.2 parts, or 1.06 mole, of amide repeat units) was added 39.1 parts of aqueous 40% glyoxal (15.64 parts, or 0.255 equivalent based on amide repeat units, of glyoxal). The pH of the resulting solution was adjusted to 9.25 by the addition of 111.3 parts of aqueous 2% sodium hydroxide. Within approximately 20 minutes after addition of the sodium hydroxide, the Gardner viscosity of the solution had increased from A to E. The reaction was then terminated by the addition of 2777 parts of water and about two and six-tenths parts of aqueous 40% sulfuric acid. The resulting solution had a pH of 4.4 and contained 2.2% solids.

EXAMPLE F

Another representative anionic, water-soluble, nitrogen-containing polymer was prepared using only acrylamide and glyoxal as reactants. In a reaction vessel equipped with a stirrer, a thermometer and a reflux condenser, there was placed 350 parts of acrylamide, one part of phenyl-β-naphthylamine and 3870 parts of chlorobenzene. This mixture was heated to 80° to 90° C. with vigorous stirring to partially melt and partially dissolve the acrylamide. One part of sodium hydroxide flake then was added to the mixture and, after an induction period, an exothermic reaction occurred and there was separation of polymer on the stirrer and on the walls of the reaction vessel. Three more one-part charges of sodium hydroxide flake were added to the reaction mixture at thirty-minute intervals, following which the reaction mixture was heated at about 90° C. for one hour. The hot chlorobenzene then was decanted, and the residual solid, a branched, water-soluble poly(β-alanine), was washed three times with acetone and subsequently dissolved at room temperature in 1000 parts of water. The cloudy solution so obtained, having a pH of about 10.5, was heated at about 75° C. for about 30 minutes to effect partial hydrolysis of the amide groups in the poly(β-alanine), and live steam was blown through the solution until the residual chlorobenzene had been removed and the last traces of polymer had dissolved. After cooling, the solution was adjusted to a pH of about 5.5 with sulfuric acid. The dissolved polymer contained about two mole percent carboxyl groups, as determined by potentiometric titration.

To an aqueous 15% solution of the above polymer was added an aqueous 40% solution of glyoxal in an amount sufficient to provide 25 mole percent of glyoxal based on the amide repeat units in the polymer. The pH of the resulting solution was slowly raised to about 9.0 to 9.5 at room temperature by the addition of dilute aqueous sodium hydroxide, and the pH was maintained at this level until an increase in Gardner viscosity of five to six units had occurred. The solution then was quickly diluted with water to 10% total solids and adjusted to a pH of 5.0 with sulfuric acid.

EXAMPLE 1

Ninety parts of isotactic polypropylene having an intrinsic viscosity of 2.1 in decahydronaphthalene at 135° C. and 10 parts of an ethylene-acrylic acid copolymer (Dow, 92:8 ethylene:acrylic acid, melt index 5.3) were charged to a closed autoclave along with 400 parts of methylene chloride as the solvent. The contents of the autoclave were stirred and heated to 220° C., at which point the vapor pressure in the autoclave was raised to 1000 p.s.i. by the introduction of nitrogen. The resulting solution was spurted from the autoclave into the atmosphere through an orifice having a diameter of one millimeter and a length of one millimeter, resulting in evaporation of the methylene chloride solvent and formation of the desired fiber product. This fiber product then was disc refined for six minutes in a Sprout Waldron disc refiner at 0.25% consistency in an aqueous medium containing 0.1% of a blend of the cationic polymer of Example A and the anionic polymer of Example E, the weight ratio of the cationic polymer to anionic polymer in the resin blend being 1:5. The refined fiber product, after washing with water, contained 8.5% of attached resin based on nitrogen analysis.

EXAMPLE 2

The spurted fiber product of Example 1 was disc refined as in that example except that an aqueous medium containing 0.05% of the blend of cationic and anionic polymers was used. The refined fiber product, after washing with water, contained 5.2% attached resin based on nitrogen analysis.

EXAMPLE 3

The procedure of Example 1 was duplicated except for use of the following conditions in preparation of the spurted fiber product: 95 parts of the polypropylene, five parts of ethylene-acrylic acid copolymer (Dow, 88:12 ethylene:acrylic acid, melt index 7.0), a mixture of 360 parts of methylene chloride and 40 parts of acetone as the solvent, a temperature of 220° C. and a pressure of 1200 p.s.i. The fiber product so obtained, after disc refining as in Example 1, contained 9.0% of deposited resin as determined by nitrogen analysis.

EXAMPLE 4

The procedure of Example 1 again was duplicated except for use this time of the following conditions in preparing the spurted fiber product: 90 parts of an isotactic polypropylene having an intrinsic viscosity of 1.3 in decahydronaphthalene at 135° C., 10 parts of ethylene-acrylic acid copolymer (Union Carbide, 94:6 ethylene:acrylic acid), 900 parts of methylene chloride as the solvent, a temperature of 200° C., and a pressure of 1000 p.s.i. The fiber product from this spurting process then was disc refined as in Example 1, resulting in fibers containing 7.2% of attached resin based on nitrogen analysis.

EXAMPLE 5

A spurted fiber product was prepared following the procedure of Example 1 except for use of 80 parts of the polypropylene, 20 parts of the ethylene-acrylic acid copolymer of Example 4, 400 parts of methylene chloride, a temperature of 210° C. and a pressure of 1000 p.s.i. The product was disc refined as in Example 1, giving a fiber product containing 6.7% of deposited resin based on nitrogen analysis.

EXAMPLES 6 and 7

Repetition of Example 5 was effected under identical conditions except for use of a 1:7 weight ratio of the cationic polymer of Example A to the anionic polymer of Example E in the resin blend in Example 6 and a 1:3 weight ratio of the polymers in Example 7. The resin pick-up in the fiber product of Example 6 was 6.5% and was 5.1% in the fiber product of Example 7.

EXAMPLE 8

Each of the synthetic pulps prepared as described in Examples 1 to 7 was blended with bleached kraft wood pulp (50:50 RBK:WBK, pH 6.5, 500 Canadian Standard Freeness) in the ratio of 30% synthetic pulp to 70% wood pulp. Handsheets prepared from the blends were dried and calendered at 500 lbs./linear inch at 60° C. The brightness, opacity, tensile strength and Mullen burst strength of the calendered sheets were determined, and the results are given in Table 1. In the data given in this table, the tensile strength and Mullen burst strength values are expressed as a percentage of the tensile strength and Mullen burst strength of the 100% wood pulp control, all being corrected to a 40 pound per ream basis weight.

Table 1

| Example | Brightness (%) | Opacity (%) | Tensile Strength (%) | Mullen Burst Strength (%) |
|---|---|---|---|---|
| 1 | 87.3 | 85.8 | 90 | 86 |
| 2 | 87.9 | 87.2 | 82 | 84 |
| 3 | 87.6 | 87.7 | 78 | 78 |
| 4 | 84.4 | 81.5 | 71 | 68 |
| 5 | 87.2 | 82.5 | 78 | 72 |
| 6 | 87.4 | 81.8 | 76 | 76 |
| 7 | 87.5 | 82.8 | 79 | 63 |

It is apparent from the above data that the process of this invention will provide paper having from about 70 to about 90% of the tensile strength and from about 60 to about 85% of the Mullen burst strength of a paper prepared from 100% wood pulp.

EXAMPLE 9

The procedure of Example 1 was followed using 200 parts of crystalline polypropylene grafted with three percent by weight of maleic anhydride, 2672 parts of methylene chloride, a temperature of 200° C. and a pressure of 1000 p.s.i. The spurted fiber product was disc refined as in Example 1, resulting in fibers containing 2.7% of deposited resin. The refined pulp was blended with wood pulp and handsheets were prepared and evaluated, as in Example 8. The resulting sheets exhibited 82% brightness, 80% opacity, 67% tensile strength and 71% Mullen burst strength.

EXAMPLE 10

The procedure of Example 1 was used to prepare a spurted fiber product from crystalline polypropylene grafted with six percent by weight of acrylic acid. A 3:2 by weight ratio of water:hexane was used as the dispersing medium. The fiber product was disc refined as in Example 1 except to use an aqueous 0.5% solution of a blend of the cationic polymer of Example A with the anionic polymer of Example F, the weight ratio of the cationic polymer to the anionic polymer being 1:3. The amount of resin deposited on the fibers was 7.2%. The refined pulp was blended with wood pulp and handsheets were prepared and evaluated, as in Example 8. The resulting sheets showed 87% brightness, 79.3% opacity and 77% tensile strength.

EXAMPLE 11

Ninety parts of high density polyethylene (DuPont, melt index 5.5–6.5 at 190° C.) was substituted for the polypropylene in Example 1 and the admixture with the ethylene-acrylic acid copolymer was spurted from solution in methylene chloride at 200° C. and 1000 p.s.i. pressure. The fiber product was disc refined as in Example 1, and the refined pulp was blended with wood pulp and handsheets were prepared and evaluated, as in Example 8. The resulting sheets showed 84% brightness, 80% opacity, 68% tensile strength and 69% Mullen burst strength.

EXAMPLE 12

One hundred and thirty parts of polypropylene having an intrinsic viscosity of 2.2 in decahydronaphthalene at 135° C., 870 parts of methylene chloride, a temperature of 222° C. and pressure of 1000 p.s.i. were used in the preparation of a fiber product following the procedure of Example 1. Sixty parts of the fiber product was suspended in 6000 parts of water, the resulting suspension was agitated, and air containing 0.7 g./cu. ft. of ozone was passed through the suspension at room temperature at a rate of 0.06 cu. ft./min. for a period of 15 minutes. Under these conditions, the ozone pickup by the fiber was 0.53% by weight of the fibers, and the fibers had an acid number corresponding to 0.033 milliequivalent of carboxyl groups per gram of fiber. The wet ozonized fibers were disc refined as in Example 1, and the refined product was found to contain 5.4% of attached resin based on nitrogen analysis. The refined pulp then was blended with wood pulp (50:50 RBK:WBK, 750 Canadian Standard Freeness), and handsheets were prepared and evaluated as in Example 8. The resulting sheets exhibited 87.3% brightness, 87.6% opacity and 84% tensile strength.

EXAMPLE 13

The procedure of Example 12 was repeated except for carrying out the ozonization reaction for one hour. The ozone pickup by the fibers was 1.9%, and the fibers had an acid number corresponding to 0.129 milliequivalent of carboxyl groups per gram of fiber. After disc refining, the fibers contained 5.1% of attached resin, and the handsheets prepared according to Example 8 showed 87.2% brightness, 87.7% opacity and 89% tensile strength.

EXAMPLE 14

The procedure of Example 13 was duplicated except for use of high density polyethylene instead of polypropylene and use of hexane as the solvent instead of methylene chloride. The ozone pickup was 1.2%, the acid number was 0.115 milliequivalent per gram, the amount of attached resin was 8.8%, and the handsheets exhibited 85% brightness, 87% opacity and 100% tensile strength.

EXAMPLE 15

Following generally the technique of Example 1, a spurted fiber product was prepared from high density polyethylene grafted with five percent of maleic anhydride. The resulting fibers were disc refined at 0.125% consistency in an aqueous medium containing 0.05% of the resin blend of Example 1. The resin pickup from the refining procedure was 5.4%, and, after blending with wood pulp and forming handsheets as in Example 8, the resulting sheets exhibited 87.5% brightness, 85% opacity and 85% tensile strength. Comparable results were obtained when the cationic polymer component of the resin blend of Example 1 was replaced with the cationic polymers of Examples B, C and D. The resulting handsheets exhibited tensile strengths of 86% (Example B polymer), 92% (Example C polymer) and 87% (Example D polymer) in comparison to the 100% wood pulp control.

Comparative data obtained from the evaluation of representative prior art processes and polymeric additives are shown in the following examples. All amounts again are based on parts by weight.

EXAMPLE 16

Following the procedure of Example 1, a fiber product was prepared from 95 parts of the polypropylene and five parts of the ethylene-acrylic acid copolymer of that example, and separate portions of the fiber product were disc refined in aqueous medium containing 0.1% of (a) the resin blend of Example 1, (b) a 1:1 blend of melamine-formaldehyde polymer (Paramel HE, American Cyanamid) and carboxymethyl cellulose (CMC, D.S. 0.4, Hercules), and (c) a 2:1 blend of the Paramel and CMC polymers. Each of the resulting pulps was blended with wood pulp, and handsheets were prepared and evaluated, all as described in Example 8. The results are shown in Table 2.

Table 2

| Additive | Brightness (%) | Opacity (%) | Tensile Strength (%) | Mullen Burst Strength (%) |
|---|---|---|---|---|
| (a) | 82.5 | 87.0 | 73.5 | 56.0 |
| (b) | 81.8 | 86.7 | 38.2 | 24.9 |
| (c) | 84.3 | 88.2 | 44.1 | 26.0 |

These data show that replacement of resin blend (a) by known blends (b) and (c) in the process of this invention does not provide a paper having the desired strength.

EXAMPLE 17

A spurted fiber product was prepared as in Example 1 except to omit the ethylene-acrylic acid copolymer and use 100 parts of polypropylene. Separate portions of the fiber product were beaten in a Waring blender in aqueous medium containing 1.0% of (a) the resin blend of Example 1, (b) the 1:1 blend of Paramel and CMC of Example 16 and (c) the 2:1 blend of Paramel and CMC of Example 16. The resulting pulps were blended with wood pulp, and handsheets were prepared and evaluated as described in Example 8. Table 3 shows the results obtained.

Table 3

| Additive | Brightness (%) | Opacity (%) | Tensile Strength (%) | Mullen Burst Strength (%) |
|---|---|---|---|---|
| (a) | 87.6 | 87.5 | 47.7 | 37.1 |
| (b) | 89.6 | 87.8 | 36.2 | 22.9 |
| (c) | 89.2 | 88.2 | 36.9 | 26.3 |

These data again show the superiority of the additive (a) of this invention over known additives (b) and (c). Moreover, by comparison to Example 16, the data with respect to additive (a) show the importance of the carboxylic functionality of the anionic polyolefin composition used in accordance with the process of this invention.

EXAMPLE 18

A 100% polypropylene spurted fiber product was prepared as in Example 17, and the product was beaten in a Waring blender in cyclohexane. The resulting fibers were solvent-exchanged first into isopropanol and then into water. To separate portions of the wet fibers in papermaking crocks there was added 0.5% based on total fiber weight of (a) the resin blend of Example 1 and (b) the 2:1 blend of Paramel and CMC of Example 16. Additional portions of the wet fibers were similarly treated with two percent of (a) and (b) based on total fiber weight. Each portion of the treated fibers then was blended with bleached kraft wood pulp in the papermaking crock in the ratio of 30% of the treated fibers to 70% of the wood pulp. Handsheets were prepared as in Example 8, but their formation was poor in comparison to that in Example 17, and the resulting paper products were not suitable for determination of physical properties.

EXAMPLE 19

Eighty parts of the polypropylene of Example 1 and 20 parts of a styrene-maleic anhydride copolymer (Arco, 75:25 styrene:maleic anhydride, molecular weight 19,000) were charged to a closed autoclave along with 250 parts of hexane and 250 parts of water. The contents of the autoclave were stirred and heated to 220° C., at which point the vapor pressure in the autoclave was raised to 1000 p.s.i. with nitrogen. The resulting emulsion was spurted from the autoclave into the atmosphere through an orifice having a diameter of one millimeter and a length of one millimeter, resulting in formation of a fiber product.

Portions of the fiber product were disc refined for six minutes in a Sprout Waldron disc refiner at 0.25% consistency in (a) water, (b) an aqueous 0.5% solution of the cationic polymer of Example A, (c) an aqueous 0.5% solution of glyoxal-modified poly(acrylamide-co-diallyldimethylammonium chloride) (Parez 631 NC, American Cyanamid), (d) an aqueous 0.5% solution of melamine-formaldehyde polymer (Paramel HE, American Cyanamid), (e) an aqueous 0.5% solution of cationic starch, and (f) an aqueous 0.5% solution of a 1:3 blend of the cationic polymer of Example A and the anionic polymer of Example F. Each of the resulting pulps was blended with wood pulp, and handsheets were prepared and evaluated, all as described in Example 8. The data so obtained are given in Table 4.

Table 4

| Refining Medium | Brightness (%) | Opacity (%) | Tensile Strength (%) | Mullen Burst Strength (%) |
|---|---|---|---|---|
| (a) | 84.2 | 81.3 | 41 | 30 |
| (b) | 85.2 | 79.8 | 51 | 48 |
| (c) | 85.5 | 81.4 | 39 | 32 |
| (d) | 81.6 | 82.5 | 48 | 38 |
| (e) | 84.8 | 79.2 | 54 | 48 |
| (f) | 82.1 | 79.4 | 72 | 71 |

These data show that individual cationic additives when used in the process of this invention are by no means as effective in providing a paper having adequate strength as is a blend of the specific cationic and anionic polymers of this invention, such as the blend used in (f).

EXAMPLE 20

The procedure of Example 1 was followed to prepare a fiber product, using 180 parts of isotactic polypropylene having an intrinsic viscosity of 2.7 in decahydronaphthalene at 135° C., 1020 parts of pentane, a temperature of 160° C. and a pressure of 850 p.s.i. The spurted fiber product was blended with six percent by weight, based on the polypropylene fibers, of wood pulp (50:50 RBK:WBK), and the fiber blend was disc refined until it became water-dispersible. One hundred ten parts of the fiber blend was suspended in 7090 parts of water, the resulting suspension was agitated, and a gas mixture containing three percent ozone in oxygen was passed through the suspension at room temperature at a rate of three and one-half cubic feet per minute for five hours. The ozonized pulp fibers had an acid number corresponding to 0.06 milliequivalent of carboxyl groups per gram of fiber.

Portions of the ozonized pulp were disc refined for six minutes in a Sprout Waldron disc refiner at 0.25% consistency in (a) water, (b) an aqueous medium containing 0.1% of the resin blend of Example 1, (c) an aqueous solution containing 0.1% of the anionic polymer of Example E, (d) an aqueous medium containing 0.1% of the resin blend of Example 10 and (e) an aqueous solution containing 0.1% of the anionic polymer of Example F. Each of the resulting pulps was blended with wood pulp, and handsheets were prepared and evaluated as described in Example 8. The data so obtained are given in Table 5.

Table 5

| Refining Medium | Brightness (%) | Opacity (%) | Tensile Strength (%) | Mullen Burst Strength (%) |
|---|---|---|---|---|
| (a) | 90.8 | 90.5 | 64 | 58 |
| (b) | 88.9 | 90.3 | 78 | 76 |
| (c) | 88.8 | 89.7 | 65 | 60 |
| (d) | 89.9 | 89.8 | 77 | 75 |
| (e) | 90.0 | 90.3 | 64 | 59 |

These data show that the individual anionic additives of this invention are not as effective as their blends with the cationic additives of this invention.

EXAMPLE 21

Other portions of the ozonized pulp of Example 20 were disc refined as in that example in (a) an aqueous medium containing 0.1% of the resin blend of Example 1, (b) an aqueous medium containing 0.1% of the resin blend of Example 7, (c) an aqueous medium containing 0.1% of a 1:1 blend of the cationic polymer of Example A and the anionic polymer of Example E and (d) an aqueous medium containing 0.1% of a 2:1 blend of the cationic polymer of Example A and the anionic polymer of Example E. As in Example 8, each of the resulting pulps was blended with wood pulp and handsheets were prepared and evaluated. Table 6 shows the results obtained.

Table 6

| Refining Medium | Brightness (%) | Opacity (%) | Tensile Strength (%) | Mullen Burst Strength (%) |
|---|---|---|---|---|
| (a) | 88.9 | 90.3 | 78 | 76 |
| (b) | 89.6 | 90.1 | 80 | 77 |
| (c) | 90.4 | 90.8 | 67 | 65 |
| (d) | 90.5 | 92.8 | 66 | 63 |

The above data show that, when the amount of the cationic polymer relative to the anionic polymer exceeds the amount defined by the 1:3 ratio of cationic:anionic specified for use in accordance with the process of this invention, there is a substantial decrease in the desired physical properties of the paper products.

The process of this invention is quite simple and attractive for the reason that it provides synthetic pulps which, when blended with wood pulp, lead to paper products having improved brightness, opacity, smoothness and printability at low sheet weights compared with conventional filled or unfilled paper. Also advantageous is the fact that the synthetic pulps of this invention do not require the presence of separate water-soluble additives, such as starch, in the papermaking process, these being rendered unnecessary by the presence of the cationic polymer component incorporated in the modified fibers produced by the process of this invention.

In the process of this invention, the anionic polyolefin composition containing carboxylic functionality may be a polyolefin containing carboxyl groups which have been introduced into the polymer molecule by grafting the polyolefin with a monomer-containing carboxylic functionality or by oxidizing the polyolefin with oxygen or ozone, or the composition may be a polyolefin in admixture with an anionic polymer containing carboxylic functionality. In any case, the polyolefin may be polyethylene, polypropylene, an ethylene-propylene copolymer or a mixture of any of these polyolefin materials.

When the anionic polyolefin composition is an admixture of a polyolefin and an anionic polymer containing carboxylic functionality, the latter component may be a polyolefin containing carboxyl groups directly attached to the polymer backbone, a polyolefin grafted with acrylic acid, methacrylic acid, maleic anhydride or mixtures thereof, a copolymer of any one of ethylene, propylene, styrene, α-methylstyrene or mixtures thereof with any one of acrylic acid, methacrylic acid, maleic anhydride or mixtures thereof, as well as mixtures of any of these anionic polymer components. Again, wherever specified, the polyolefin may be polyethylene, polypropylene, an ethylene-propylene copolymer or mixtures thereof.

In the foregoing admixtures of polyolefin and anionic polymer containing carboxylic functionality, the ratio of the former to the latter will preferably be from about 95:5 to about 80:20 by weight, and the amount of available carboxyl in the anionic polymer will be from about three to about 30% by weight. In general, the anionic polyolefin composition used in the process of this invention should contain a sufficient amount of carboxylic functionality to provide at least 0.01, and preferably at least about 0.04 milliequivalent of carboxyl groups per gram of the polyolefin pulp. Moreover, the amount of carboxylic functionality may be such as to provide up to about one milliequivalent of carboxyl groups per gram of the polyolefin pulp. A highly desirable range is from about 0.04 to about 0.2 milliequivalent per gram.

The dispersing medium used in the fiber-forming step of the process of this invention contains an organic solvent which is a nonsolvent at its normal boiling point for the polyolefin composition used to form the fibers. It may be the methylene chloride shown in most of the examples, or other halogenated hydrocarbons such as chloroform, carbon tetrachloride, methyl chloride, ethyl chloride, trichlorofluoromethane and 1,1,2-trichloro-1,2,2-trifluoroethane. Also useful are aromatic hydrocarbons such as benzene, toluene and xylene; aliphatic hydrocarbons such as butane, pentane, hexane, heptane, octane and their isomers; and alicyclic hydrocarbons such as cyclohexane. Mixtures of these solvents may be used, and water may be present when it is desired to form an emulsion of the polyolefin composition. Moreover, the pressure generated by the solvent vapors may be, and normally will be, augmented by a pressurized inert gas such as nitrogen or carbon dioxide.

In carrying out the fiber-forming process, the concentration of the polyolefin composition in solution in the solvent normally will be from about 5 to about 40% by weight, preferably from about 10 to about 20% by weight. The temperature to which the dispersion of the polyolefin composition in the solvent is heated to form a solution of the composition will be dependent upon the particular solvent used and should be sufficiently high to effect dissolution of the composition. The fiber-forming temperature will generally be in the range of from about 100° to about 225° C. The pressure on the solution of the polyolefin composition may be from about 600 to about 1500 p.s.i., but preferably is in the range of from about 900 to about 1200 p.s.i. The orifice through which the solution is discharged should have a diameter of from about 0.5 to about 15 mm., preferably from about one to about five mm., and the ratio of the length of the orifice to its diameter should be from about 0.2 to about 10.

In the fiber-modifying step of the process of this invention, the fibers of the fibrous anionic polyolefin composition containing carboxylic functionality are intimately contacted with a dilute aqueous admixture of certain cationic and anionic nitrogen-containing polymers, resulting in the deposition on the fibers of from about one to about 15% by weight of the admixture, based on the weight of the fibrous composition. The ratio of cationic to anionic polymer in the blend preferably is in the range of from about 1:3 to about 1:7 by weight. The cationic polymer component of the aforementioned blend may generally be classified as the reaction product of epichlorohydrin and a polymer containing secondary or tertiary amine groups, or both. One representative group of polymers belonging to this defined class may be exemplified by the cationic polymer component used in many of the examples, namely, the reaction product of epichlorohydrin and the aminopolyamide derived from diethylenetriamine and adipic acid. Preparation of this product is shown in Example A. However, more generally, this group of cationic polymers are the reaction products of epichlorohydrin and an aminopolyamide derived from a dicarboxylic acid and a polyalkylenepolyamine having two primary amine groups and at least one secondary or tertiary amine group.

Particularly suitable dicarboxylic acids are diglycolic acid and saturated aliphatic dicarboxylic acids containing from 3 through 10 carbon atoms such as malonic acid, succinic acid, glutaric acid, adipic acid, pimelic acid, suberic acid, azelaic acid, and sebacic acid. Other suitable dicarboxylic acids include terephthalic acid, isophthalic acid, phthalic acid, maleic acid, fumaric acid, itaconic acid, glutaconic acid, citraconic acid, and mesaconic acid. The available anhydrides of the above acids can be used in preparing the water-soluble aminopolyamide as well as the esters of the acids. Mixtures of two or more dicarboxylic acids, their anhydrides, and their esters can be used to prepare the water-soluble aminopolyamides, if desired.

A number of polyalkylene polyamines, including polyethylene polyamines, polypropylene polyamines, polybutylene polyamines and the like can be employed. Polyalkylene polyamines can be represented as polyamines in which the nitrogen atoms are linked together by groups of the formula $—C_nH_{2n}—$ where n is a small integer greater than unity and the number of such groups in the molecule ranges from two up to about eight. The nitrogen atoms can be attached to adjacent carbon atoms in the group $—C_nH_{2n}—$ or to carbon atoms farther apart, but not to the same carbon atom. Polyamines such as diethylenetriamine, triethylenetetramine, tetraethylenepentamine, and dipropylenetriamine, which can be obtained in reasonably pure form are suitable for preparing water-soluble aminopolyamides. Other polyalkylene polyamines that can be used include methyl bis-(3-aminopropyl)amine; methyl bis-(2-aminoethyl)amine; and 4,7-dimethyltriethylenetetramine. Mixtures of polyalkylene polyamines can be used, if desired.

The spacing of an amino group on the aminopolyamide can be increased if desired. This can be accomplished by substituting a diamine such as ethylenediamine, propylenediamine, hexamethylenediamine and the like for a portion of the polyalkylene polyamine. For this purpose, up to about 80% of the polyalkylene polyamine can be replaced by a molecularly equivalent amount of diamine. Usually, a replacement of about 50% or less will be adequate.

The temperatures employed for carrying out the reaction between the dicarboxylic acid and the polyalkylenepolyamine may vary from about 110° C. to about 250° C. or higher at atmospheric pressure. For most purposes, however, temperatures between about 160° C. and 210° C. have been found satisfactory and are preferred. Where reduced pressures are employed, somewhat lower temperatures may be utilized. The time of reaction depends on the temperatures and pressures utilized and will ordinarily vary from about one-half to two hours, although shorter or longer reaction times may be utilized depending on reaction conditions. In any event, the reaction is desirably continued to substantial completion for best results.

In carrying out the reaction, it is preferred to use an amount of dicarboxylic acid sufficient to react substantially completely with the primary amine groups of the polyalkylenepolyamine but insufficient to react with the secondary and/or tertiary amine groups to any substantial extent. This will usually require a mole ratio of polyalkylenepolyamine to dicarboxylic acid of from about 0.9:1 to about 1.2:1. However, mole ratios of from about 0.8:1 to about 1.4:1 may be used with quite satisfactory results. Mole ratios outside of these ranges are generally unsatisfactory. Thus, mole ratios below about 0.8:1 result in a gelled product or one having a pronounced tendency to gel while mole ratios above 1.4:1 result in low molecular weight polyamides. Such products when reacted with epichlorohydrin, do not produce resins having the desired efficiency for use herein.

In converting the aminopolyamide, formed as above described, to a cationic thermosetting resin, it is reacted with epichlorohydrin at a temperature from about 45° C. to about 100° C. and preferably between about 45° C. and 70° C. until the viscosity of a 20% solids solution at 25° C. has reached about C or higher on the Gardner scale. This reaction is preferably carried out in aqueous solution to moderate the reaction. pH adjustment is usually not necessary. However, since the pH decreases during the polymerization phase of the reaction it may be desirable, in some cases, to add alkali to combine with at least some of the acid formed.

When the desired viscosity is reached, sufficient water is then added to adjust the solids content of the resin solution to the desired amount, i.e., about 10% more or less, the product cooled to about 25° C. and then stabilized by adding sufficient acid to reduce the pH at least to about 6 and preferably to about 5. Any suitable acid such as hydrochloric, sulfuric, nitric, formic, phosphoric and acetic acid may be used to stabilize the product. However, sulfuric acid is preferred.

In the aminopolyamide-epichlorohydrin reaction, it is preferred to use sufficient epichlorohydrin to convert all secondary amine groups to tertiary amine groups. However, more or less may be added to moderate or increase reaction rates. In general, satisfactory results may be obtained utilizing from about 0.5 mole to about 1.8 moles of epichlorohydrin for each secondary or tertiary amine group of the aminopolyamide. It is preferred to utilize from about 1.0 mole to about 1.5 moles for each secondary amine group of the aminopolyamide.

Another representative group of polymers belonging to the broadly defined class of cationic polymers is that wherein the polymers are water-soluble reaction products of epichlorohydrin and a polyalkylene polyamine. The preparation of an exemplary product from this group is shown in Example B.

Polyalkylene polyamines which can be reacted with epichlorohydrin have the formula $H_2N(C_nH_{2n}NH)_xH$ wherein n is an integer 2 through 8 and x is an integer 2 or more, preferably 2 through 6. Examples of such polyalkylene polyamines are the polyethylene polyamines, polypropylene polyamines and polybutylene polyamines. Specific examples of these polyalkylene polyamines include diethylenetriamine, triethylenetetramine, tetraethylenepentamine, bis(hexamethylene)triamine and dipropylenetriamine. Other polyalkylene polyamines that can be used include methyl bis(3-aminopropyl)amine; methyl bis(2-aminoethyl)amine; and 4,7-dimethyltriethylenetetramine. Mixtures of polyalkylene polyamines can be used if desired.

The relative proportions of polyalkylene polyamine and epichlorohydrin employed can be varied depending upon the particular polyalkylene polyamine used. In general, it is preferred that the molar ratio of epichlorohydrin to polyalkylene polyamine be in excess of 1:1 and less than 4.5:1. In the preparation of water-soluble resin from epichlorohydrin and tetraethylenepentamine, good results are obtained at molar ratios of from about 1.4:1 to 1.94:1. Reaction temperature is preferably in the range of from about 40° to about 60° C.

A further group of cationic polymers useful in accordance with this invention is that in which the polymers are the reaction products of epichlorohydrin and a poly(diallylamine). The preparation of such a product is shown in Example C. The poly(diallylamine) is a linear polymer having units of the formula:

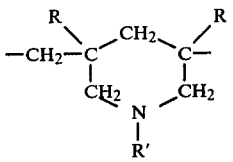

where R is hydrogen or lower alkyl and R′ is hydrogen, alkyl or a substituted alkyl group.

Polymers having units of the above formula are obtained by polymerizing the hydrohalide salt of a diallylamine having the formula:

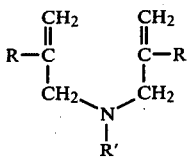

in which R and R′ are as indicated above, in the presence of a free radical catalyst and then neutralizing the salt to give the polymer free base. In both of the above formulae, each R can be the same or different, and, as stated, can be hydrogen or lower alkyl. The alkyl groups contain from 1 to 6 carbons and are preferably methyl, ethyl, isopropyl or n-butyl. R′ of the formula represents hydrogen, alkyl or substituted alkyl groups. The R′ alkyl groups will contain from 1 to 18 carbon atoms (preferably from 1 to 6 carbon atoms) such as methyl, ethyl, propyl, isopropyl, butyl, tert-butyl, hexyl, octyl, decyl, dodecyl, tetradecyl, and octadecyl. R′ can also be substituted alkyl group. Suitable substituents include, in general, any group which will not interfere with polymerization through a vinyl double bond. Typically, the substituents can be carboxylate, cyano, ether, amino (primary, secondary or tertiary), amide, hydrazide and hydroxyl.

Specific hydrohalide salts of the diallylamines which can be polymerized to provide the polymer units of the invention include diallylamine hydrochloride; N-methyldiallylamine hydrochloride; N-methyldiallylamine hydrobromide; 2,2′-dimethyl-N-methyldiallylamine hydrochloride; N-ethyldiallylamine hydrobromide; N-isopropyldiallylamine hydrochloride; N-n-butyldiallylamine hydrobromide; N-tert-butyldiallylamine hydrochloride; N-n-hexyldiallylamine hydrochloride; N-octadecyldiallylamine hydrochloride; N-acetamidodiallylamine hydrochloride; N-cyanomethyldiallylamine hydrochloride; N-β-propionamidodiallylamine hydrobromide; N-carboethoxymethyldiallylamine hydrochloride; N-β-methoxyethyldiallylamine hydrobromide; N-β-aminoethyldiallylamine hydrochloride; N-hydroxyethyldiallylamine hydrobromide; and N-acetohydrazide substituted diallylamine hydrochloride.

Diallylamines and N-alkyldiallylamines, used to prepare the polymers employed in this invention can be prepared by the reaction of ammonia or a primary amine with an allyl halide. Thus, for example, N-methyldiallylamine can be prepared by reaction of two moles of an allyl halide, such as allyl chloride, with one mole of methylamine.

In preparing the diallylamine polymers, reaction can be initiated by redox catalytic system. In a redox system, the catalyst is activated by means of a reducing agent which produces free radicals without the use of heat. Reducing agents commonly used are sodium metabisulfite and potassium metabisulfite. Other reducing agents include water-soluble thiosulfates and bisulfites, hydrosulfites and reducing salts such as the sulfate of a metal which is capable of existing in more than one valence state such as cobalt, iron, manganese and copper. A specific example of such a sulfate is ferrous sulfate. The use of a redox initiator system has several advantages, the most important of which is efficient polymerization at lower temperatures. Conventional peroxide catalysts such as tertiary-butyl hydroperoxide, potassium persulfate, hydrogen peroxide, and ammonium persulfate used in conjunction with the above reducing agents or metal activators, can be employed.

In the reaction of the poly(diallylamine) with epichlorohydrin, the latter is used in an amount ranging from about 0.5 mole to about 1.5 moles, preferably from about one mole to about 1.5 moles, per mole of secondary plus tertiary amine present in the polymer. The reaction is carried out at a temperature of from about 30° to about 80° C., preferably from about 40° to about 60° C., until the viscosity measured at 25° C. on a solution containing 20 to 30% solids is in the range of A to E, and preferably C to D, on the Gardner scale. The reaction preferably is carried out in aqueous solution to moderate the reaction, and at a pH of from about 7 to about 9.5. When the desired viscosity is reached, sufficient water is added to adjust the solids content of the resin solution to about 25% or less, and the solution is cooled to room temperature. The poly(diallylamine)-epichlorohydrin product can be stabilized against gelation by adjusting the pH of the solution to about 2 with, for example, sulfuric or hydrochloric acid.

The final group of cationic polymers used in accordance with this invention is that wherein the polymers are the reaction products of epichlorohydrin and a polyaminourylene. The preparation of one of these products is given in Example D.

The polyaminourylenes are water-soluble materials containing tertiary amine groups and/or mixtures of tertiary amine groups with primary and/or secondary amine groups and/or quaternary ammonium groups. However, tertiary amine groups should account for at least 70% of the basic nitrogen groups present in the polyaminourylene. These polyaminourylenes may be prepared by reacting urea with certain polyamines containing tertiary amine groups. The reaction can, if desired, be carried out in a suitable solvent such as xylene.

The polyamine reactant should have at least three amine groups, at least one of which is a tertiary amine group. It may also have secondary amine groups in limited amounts. Typical polyamines of this type suitable for use as hereinabove described are methyl bis(3-aminopropyl)amine, methyl bis(2-aminoethyl)amine, N-(2-aminoethyl)piperazine, and 4,7-dimethyltriethylenetetramine in reasonably pure form, or mixtures containing one or more of such materials.

The temperatures employed for carrying out the reaction between the urea and the polyalkylene polyamine may vary from about 125° C. to about 250° C. at atmospheric pressure. For most purposes, however, temperatures between about 175° C. and about 225° C. have been found satisfactory and are preferred. The time of reaction will vary depending upon the temperature, but will usually be from about one-half hour to about four hours. In any event, the reaction is desirably continued to substantial completion for best results. In carrying out the reaction between the urea and the polyamine, it is preferred to use a mole ratio of polyamine to urea of about 1:1. However, mole ratios from about 0.7:1 to about 1.5:1 can be used.

In converting the polyaminourylene, formed as above described, to a cationic thermosetting resin, it is reacted with epichlorohydrin at a temperature of from about 25° C. to about 80° C., and preferably at a temperature of from about 35° C. to about 50° C., until the viscosity of a 25% solids solution at 25° C. has reached about B or higher on the gardner scale. This reaction is preferably carried out in aqueous solution at solids concentrations of from about 20% to about 50% to moderate the reaction. The reaction may also be moderated by decreasing the pH of the aqueous polyaminourylene solution with acid prior to addition of epichlorohydrin or immediately after the addition of epichlorohydrin. This adjustment is usually made to a pH of 8.5–9.5 but may be made to as low as a pH of 7.5 in some cases with quite satisfactory results.

When the desired viscosity is reached, the product is cooled to about 25° C. Since the product is stable on both the acid and alkaline sides, pH adjustment is not necessary. However, if desired, the pH may be adjusted to at least as low as 7.0 by the addition of sulfuric or other acid.

In the polyaminourylene-epichlorohydrin reaction, it is preferred to use a mole ratio of epichlorohydrin to free amine groups in the polyaminourylene of from about 1.0:1 to about 1.7:1. However, more or less may be added to moderate or increase reaction rates. In general, satisfactory results may be obtained utilizing from about 0.8 mole to about 2.0 moles of epichlorohydrin for each free amine group of the polyaminourylene.

The anionic polymer component of the aqueous solution or dispersion in which the fibers of the anionic polyolefin composition containing carboxylic functionality are modified is illustrated in the examples. One of these is the reaction product of glyoxal and the polyacrylamide obtained by copolymerization of acrylamide with acrylic acid. The preparation of an exemplary product is shown in Example E. The amount of acrylic acid units in the copolymer may be from about two to about 15%. Comparable products can be prepared by partial hydrolysis of polyacrylamide or a poly(acrylamide-co-alkyl acrylate) such as a copolymer of acrylamide with ethyl acrylate. Any of these polyacrylamides can be prepared by conventional methods for the polymerization of water-soluble monomers and preferably have molecular weights less than about 25,000, for example, in the range of from about 10,000 to about 20,000.

The other anionic, nitrogen-containing polymer shown in the examples is the reaction product of glyoxal and the polymer obtained by partial hydrolysis of a branched, water-soluble poly(β-alanine). Preparation of a representative product is shown in Example F. The poly(β-alanine) is prepared by the anionic polymerization of acrylamide in the presence of a basic catalyst and a vinyl or free-radical polymerization inhibitor, and the polymer will have a molecular weight in the range of from about 500 to about 10,000, preferably from about 2000 to about 6000. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane. The concentration of the acrylamide monomer in the reaction medium is in the range of from about two to about 30%, and is preferably from about eight to about 15%. If desired, an organo-soluble polymeric dispersing agent can be added to the reaction mixture prior to the addition of the basic catalyst. When the dispersing agent is employed, the poly(β-alanine) produced is in powdered or bead form, easily filterable from the reaction medium. Suitable dispersing agents are styrene-butadiene copolymers, polyisoprene, chlorinated polypropylene, chlorinated and maleated polyisoprene and chlorinated and maleated polyolefins.

Illustrative basic catalysts which can be employed include alkali metals, alkali metal hydroxides, alkaline earth metal hydroxides, quaternary ammonium hydroxides and the alkali metal alkoxides. Specific examples of suitable basic catalysts are sodium, sodium hydroxide, lithium hydroxide, potassium hydroxide, sodium t-butoxide, sodium methoxide, tetramethylammonium hydroxide, potassium t-butoxide and calcium hydroxide. The amount of catalyst used is in the range of about 0.01 to about 2.0 mole %, preferably about 0.1 to about 1.5 mole %, based on the monomer. A free radical inhibitor is added to the reaction mixture to inhibit vinyl polymerization through the double bond of the acrylamide monomer. Examples of free radical inhibitors which can be used are phenyl-β-naphthylamine, hydroquinone, diphenylamine and phenothiazine. The polymerization reaction is conducted at temperatures in the range of from about 40° to about 140° C. and preferably from about 80° to about 130° C. In some cases, the anionic polymerization of acrylamide under the preceding conditions will produce a mixture of water-soluble and water-insoluble poly(β-alanine). The water-soluble polymer can be readily separated by partially dissolving the polymer product in water and removing the insoluble fraction by conventional methods such as filtration.

The branched poly(β-alanine) produced as described above is a neutral polymer and needs to be anionically modified for the purpose of this invention. Anionic modification of branched poly(β-alanine) can be accomplished by partial hydrolysis of the polymer to convert some of the primary amide groups into anionic carboxyl groups. For example, hydrolysis of poly(β-alanine) can take place by heating a slightly basic aqueous solution of the polymer having a pH of about 9 to 10 at temperatures of about 50° to about 100° C. The amount of anionic groups introduced should be from about one to about ten mole percent, and preferably about two to about five mole percent, based on amide repeating units.

Each of the anionic, nitrogen-containing polymers described above is modified with glyoxal to provide the desired anionic, water-soluble, nitrogen-containing polymers used in accordance with this invention. The reaction with glyoxal is carried out in a dilute neutral or slightly alkaline aqueous solution of the polymer at a temperature of from about 10° to about 50° C., preferably from about 20° to about 30° C. The concentration of the polymer in the solution may be from about five to about 40% by weight, but preferably is from about seven to about 20%. The amount of glyoxal used in the reaction mixture may be from about 10 to about 100 mole percent, preferably from about 20 to about 30 mole percent, based on amide repeat units in the polymer. The reaction is allowed to continue until a viscosity increase of from about two to about ten, preferably from about four to about six, units on the Gardner scale has taken place. This increase in viscosity is indicative that some crosslinking of the polymer has desirably taken place, but this amount of crosslinking is insufficient to cause gelation. The reaction then is terminated, usually by dilution of the reaction mixture with water and addition of sulfuric acid to lower the pH to about 4.5–5.0. The resulting solutions possess good stability.

The process of this invention makes possible the preparation of improved paper products from blends of wood pulp and polyolefin pulps. The process depends upon the particular combination of cationic and anionic nitrogen-containing polymers used to modify the fibers in the disc refining step of the process. Moreover, the process depends upon several critical factors, namely, the presence of at least 80% polyolefin in the polyolefin-carboxyl-containing anionic polymer admixture, when this admixture constitutes the anionic polyolefin composition containing carboxylic functionality used as the fiber-forming material, an intrinsic viscosity of at least 1.0 for the polyolefin, sufficient available carboxyl in the anionic polyolefin composition containing carboxylic functionality and sufficient resin in the aqueous solution or dispersion in which the anionic fibers are modified. However, operation within the limits of these conditions makes it possible to produce a synthetic pulp which, when blended with wood pulp, will provide a paper product having at least 70% of the tensile strength of 100% wood pulp, as well as increased brightness, opacity and smoothness.

What I claim and desire to protect by Letters Patent is:

1. A process for the preparation of a fibrous pulp containing hydrophilic polyolefin fibers which comprises disc refining a spurted fibrous polyolefin composition containing carboxylic functionality in a dilute aqueous admixture of water-soluble nitrogen-containing cationic and anionic polymers, said cationic polymer being the reaction product of epichlorohydrin and (a) an aminopolyamide derived from a dicarboxylic acid and a polyalkylene polyamine having two primary amine groups and at least one secondary or tertiary amine group, or (b) a polyalkylene polyamine having the formula $H_2N(C_nH_{2n}NH)_xH$, wherein n is an integer 2 through 8 and x is an integer 2 or more, or (c) a poly(diallylamine) or (d) a polyaminourylene derived from urea and a polyamine having at least three amine groups, at least one of which is tertiary, and said anionic polymer being the reaction product of glyoxal and (a) a polyacrylamide containing from about 2 to about 15% acrylic acid units or (b) a partially hydrolyzed, branched poly(β-alanine) containing from about 1 to about 10 mole percent carboxyl groups based on amide repeating units, the ratio of said cationic polymer to said anionic polymer in said admixture of said polymers being in the range of from about 1:3 to about 1:7 by weight and the amount of said admixture of said polymers deposited on the fibers of said fibrous composition being from about one to about 15% by weight based on said fibrous composition.

2. The process of claim 1 wherein the spurted fibrous polyolefin composition containing carboxylic functionality is based on polyethylene.

3. The process of claim 1 wherein the spurted fibrous polyolefin composition containing carboxylic functionality is based on polypropylene.

4. The process of claim 3 wherein the spurted fibrous polyolefin composition containing carboxylic functionality is prepared by spurting a mixture of polypropylene and an anionic polymer containing carboxylic functionality.

5. The process of claim 4 wherein the anionic polymer containing carboxylic functionality is a copolymer of ethylene and acrylic acid.

6. The process of claim 3 wherein the spurted fibrous polyolefin composition containing carboxylic functionality is prepared by spurting polypropylene and oxidizing the resulting fibers to introduce carboxyl groups into the polypropylene molecule.

7. The process of claim 1 wherein the cationic, water-soluble, nitrogen-containing polymer is the reaction product of epichlorohydrin and an aminopolyamide derived from a dicarboxylic acid and a polyalkylene polyamine having two primary amine groups and at least one secondary or tertiary amine group.

8. The process of claim 7 wherein the aminopolyamide is derived from adipic acid and diethylenetriamine.

9. The process of claim 8 wherein the anionic, water-soluble, nitrogen-containing polymer is the reaction product of glyoxal and the polyacrylamide obtained by copolymerization of acrylamide with acrylic acid.

10. The process of claim 8 wherein the anionic, water-soluble, nitrogen-containing polymer is the reaction product of glyoxal and the polymer obtained by partial hydrolysis of a branched, water-soluble poly(β-alanine).

* * * * *